US011702911B2

(12) United States Patent
Teurlay et al.

(10) Patent No.: US 11,702,911 B2
(45) Date of Patent: Jul. 18, 2023

(54) SYSTEM AND METHOD FOR MECHANICAL TUBING PUNCHER

(71) Applicant: Schlumberger Technology Corporation, Sugar Land, TX (US)

(72) Inventors: Lucas Teurlay, Houston, TX (US); Gregory Giem, Houston, TX (US); Joshua Wurtz, Houston, TX (US); Matthew Dresel, Princeton Junction, NJ (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/717,693

(22) Filed: Dec. 17, 2019

(65) Prior Publication Data

US 2020/0190951 A1 Jun. 18, 2020

Related U.S. Application Data

(60) Provisional application No. 62/780,668, filed on Dec. 17, 2018.

(51) Int. Cl.
*E21B 43/112* (2006.01)

(52) U.S. Cl.
CPC ..... *E21B 43/112* (2013.01)

(58) Field of Classification Search
CPC ..... E21B 43/112
See application file for complete search history.

(56) References Cited

U.S. PATENT DOCUMENTS 1,785,419 A * 12/1930 Moss ..... E21B 43/112 166/55.3
2,638,165 A * 5/1953 Barber ..... E21B 43/112 166/55.2
5,165,274 A * 11/1992 Thiercelin ..... E21B 49/006 73/152.59
5,411,106 A * 5/1995 Maissa ..... E21B 49/06 175/254
6,658,908 B1 * 12/2003 Ghiran ..... B21D 26/035 72/55
2011/0240294 A1 * 10/2011 Johnston ..... E21B 43/112 166/298
2013/0175035 A1 * 7/2013 Lee ..... E21B 43/26 166/298

(Continued)

OTHER PUBLICATIONS

DPU Tubing Punch, 2015, (2 pages) https://www.halliburton.com/content/dam/ps/public/lp/contents/Data_Sheets/web/H/DPU-Tubing-Punch.pdf?nav=en-US_wireline-perforating_public.

(Continued)

*Primary Examiner* — Cathleen R Hutchins
*Assistant Examiner* — Ronald R Runyan
(74) *Attorney, Agent, or Firm* — Jeffrey D. Frantz

(57) ABSTRACT

A downhole puncher tool may include a pump system configured to produce a force. The downhole puncher tool may include a plurality of arm systems. Each arm system may have one or more arms that are configured to extend radially outward from the downhole puncher tool upon receiving the force from the pump system. In some embodiments, at least one arm system of the plurality of arm systems comprises a punching insert that is coupled to an arm of the one or more arms, and the punching insert may have a projecting surface.

20 Claims, 8 Drawing Sheets

(56) References Cited

U.S. PATENT DOCUMENTS

2014/0332270 A1* 11/2014 Odell, II ..... E21B 7/128
175/40
2015/0226032 A1* 8/2015 Kratochvil ..... E21B 34/103
166/55.1

OTHER PUBLICATIONS

Otis A Type Tubing Perforator Punch, (1 page) http://www.hunting-intl.com/media/1535682/A_Type_Perf.pdf, downloaded in Jul. 2020.
Data Sheet Welltec Puncher 318 Standard, 2019 (1 page).
Single Shot Tubing Puncher, (3 pages) https://www.nov.com/products/single-shot-tubing-punch, downloaded in Jul. 2020.
Gator Penetrator (2 pages) http://Ieeenergysystems.com/home/gator/, downloaded in Jul. 2020.
Hydraulic Tubing Puncher, (2 pages) https://www.bracetool.com/images/downloads/e663ef240b534817b4c621311cc1c888.pdf, downloaded in Jul. 2020.

* cited by examiner

SYSTEM AND METHOD FOR MECHANICAL TUBING PUNCHER

CROSS-REFERENCE TO RELATED APPLICATIONS

This disclosure claims the benefit of and priority to U.S. Provisional Patent Application No. 62/780,668, titled "System and Method for Mechanical Tubing Puncher," filed Dec. 17, 2018, which is incorporated by reference herein in its entirety for all purposes.

BACKGROUND

This disclosure relates generally to downhole tools and more specifically to tools generating perforations in casings and/or tubing disposed within a borehole.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A wellbore drilled into a geological formation may be targeted to produce oil and/or gas from certain zones of the geological formation. In some scenarios, to prevent geological zones (e.g., at different depths) from interacting with one another via the wellbore, and to prevent fluids from undesired zones from entering the wellbore, a cylindrical casing may be placed into the wellbore. Additionally, the cylindrical casing may be cemented in place by depositing cement between the cylindrical casing and a wall of the wellbore. As such, during cementing, cement may be injected into the open annulus formed between the cylindrical casing and the geological formation (i.e., the wall of the wellbore). When the cement properly sets, fluids from one zone of the geological formation may not be able to pass through the wellbore to interact with another zone. This desirable condition may be referred to as "zonal isolation."

The cement maintains the pressure integrity of the well throughout the life of the well. However, in certain situations, it may be desirable to induce perforations inside a tubing and the annulus of the casing to equalize pressure or to increase production.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

One embodiment of the present disclosure relates to a downhole puncher tool and may include a pump system configured to produce a force. The downhole puncher tool may include multiple arm systems. Each arm system may have one or more arms that are configured to extend radially outward from the downhole puncher tool upon receiving the force from the pump system. In some embodiments, at least one arm system of the plurality of arm systems comprises a punching insert that is coupled to an arm of the one or more arms, and the punching insert may have a projecting surface.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
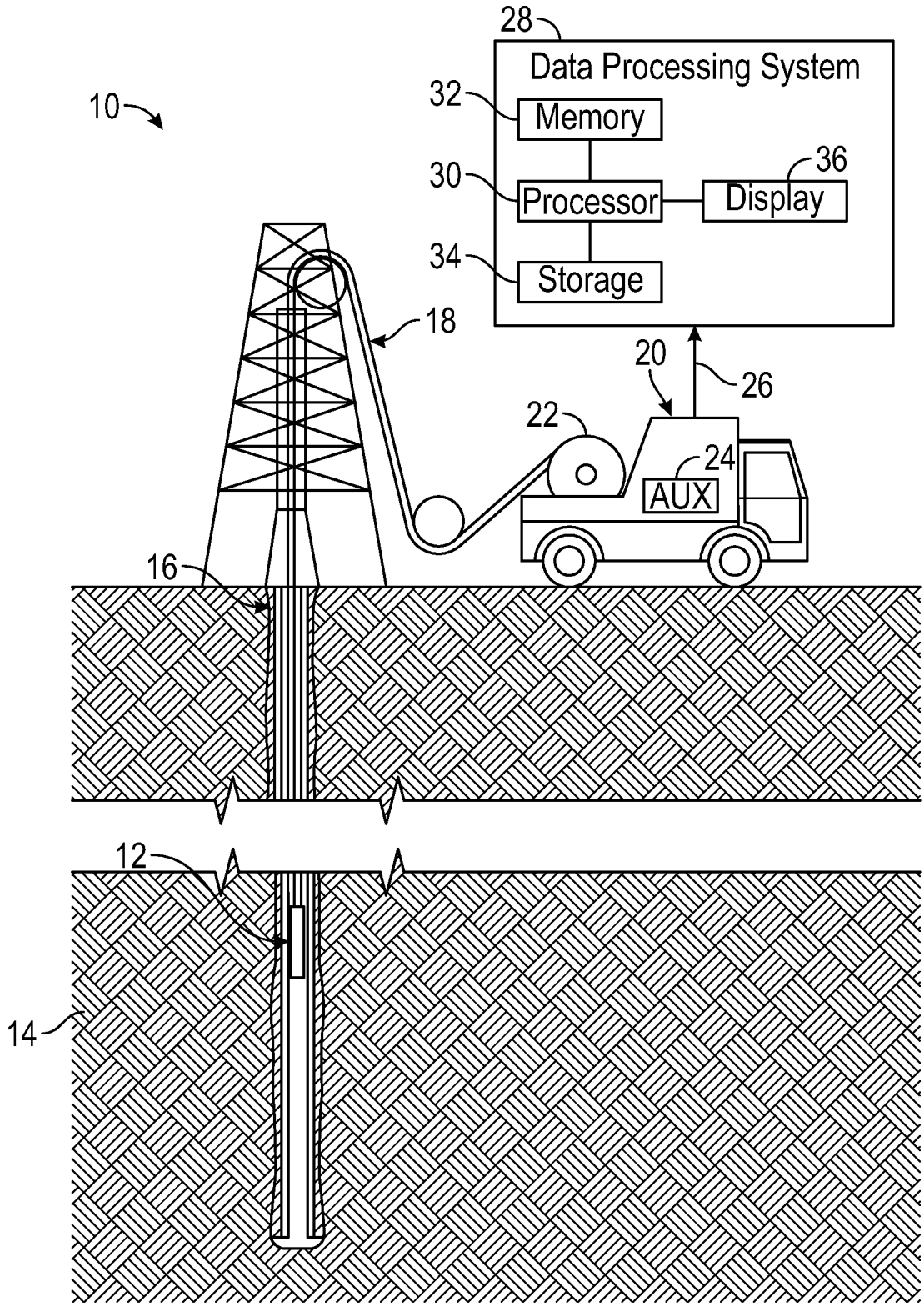
FIG. 1 is a partial cross sectional view of a well-logging and perforating system that may be used to bring a well into production, perform well diagnostics, or remediate or repair a well after it has been drilled through the subsurface formations, in accordance with an embodiment of the present techniques.

One or more specific embodiments of the present disclosure will be described below. These described embodiments are only examples of the presently disclosed techniques. Additionally, to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

During well-logging operations it may be advantageous to generate holes inside the tubing and casing to equalize pressure between the tubing and the casing. Certain conventional techniques for producing holes in the tubing and casing may produce burrs, which may increase a likelihood of damaging the casing and/or damaging components moving through the casing. Additionally, certain conventional techniques, such as using explosives to generate holes, may not have a reliable means for monitoring and/or providing feedback of the operation, and thus, an operator may not have suitable data to determine whether or not the holes were generated successfully (e.g., penetrated through the casing or did not result in damaging the casing). Further, techniques such as explosives may require several hours of certification before an operator can proceed with operations, which increases the cost of well-logging operations.

The present disclosure relates to generating holes in a well in a controlled manner. For example, one embodiment in accordance with the present disclosure relates to a puncher tool having a plurality of arm systems that may include punching inserts having a projecting surface for producing perforations in a casing and/or tubing. The puncher tool may be coupled to a pump system, such as a downhole hydraulic pump, and electronics that may control various tools, actuators, and provide telemetry to the surface. In some embodiments, the projecting surface may be a tooth structure as described herein. In general, the puncher tool may create holes within the casing and/or tubing to equalize pressure between the inside of the tubing and the annulus. In some embodiments, the puncher tool may be used to perform a squeeze cement job. In some embodiments, the puncher tool may apply a force on the casing and/or tubing via a hydraulic pump, which may be coupled to one or more sensors that may measure data indicative of an applied force or pressure of the punching inserts on the casing and/or tubing. Sensors may further measure direct current (DC), arm diameter, and downhole temperature and pressure. The measured data is sent to an operator or a data processing system at the surface, which can be interpreted in real time. Such real time feedback may indicate whether or not perforations or punctures were successfully created. The arm pressure, arm force, DC current, and radial arm extension length or arm diameter measurements may be used to confirm mechanical punch(es) from a tool standpoint, while the downhole temperature and pressure may be used to confirm mechanical punch(es) from a wellbore standpoint. The punching insert may comprise or be composed of a material having suitable mechanical properties, such as material hardness, yield strength, or be more ductile. For example, the punching insert may be sufficiently hard to produce perforations but brittle such that it may break into small pieces in situations where the punching tool is unable to produce perforations or is stuck.

FIG. 1 illustrates a well-logging and perforating system 10 that may employ the systems and methods of this disclosure. The well-logging and perforating system 10 may be used to convey a downhole tool 12 through a geological formation 14 via a wellbore 16. The downhole tool 12 may be conveyed on a cable 18 via a logging winch system 20. Although the logging winch system 20 is schematically shown in FIG. 1 as a mobile logging winch system carried by a truck, the logging winch system 20 may be substantially fixed (e.g., a long-term installation that is substantially permanent or modular). Any suitable cable 18 for well logging may be used. The cable 18 may be spooled and unspooled on a drum 22 and an auxiliary power source 24 may provide energy to the logging winch system 20 and/or the downhole tool 12.

Moreover, although the downhole tool 12 is described as a wireline downhole tool, it should be appreciated that any suitable conveyance may be used. For example, the downhole tool 12 may instead be conveyed as a logging-while-drilling (LWD) tool as part of a bottom hole assembly (BHA) of a drill string, conveyed on a slickline or via coiled tubing, and so forth. For the purposes of this disclosure, the downhole tool 12 may be any suitable measurement tool that obtains logging measurements through depths of the wellbore 16. For example, such logging measurements may include, but are not limited to, density, resistivity, photoelectric absorption properties, neutron spectroscopy, and the like.

To this end, the data processing system 28 thus may be any electronic data processing system that can be used to carry out the systems and methods of this disclosure. For example, the data processing system 28 may include a processor 30, which may execute instructions stored in memory 32 and/or storage 34. As such, the memory 32 and/or the storage 34 of the data processing system 28 may be any suitable article of manufacture that can store the instructions. The memory 32 and/or the storage 34 may be ROM memory, random-access memory (RAM), flash memory, an optical storage medium, or a hard disk drive, to name a few examples. A display 36, which may be any suitable electronic display, may provide a visualization, a well log, or other indication of properties in the geological formation 14 or the wellbore 16 using logging measurements 26.

Figure 2:
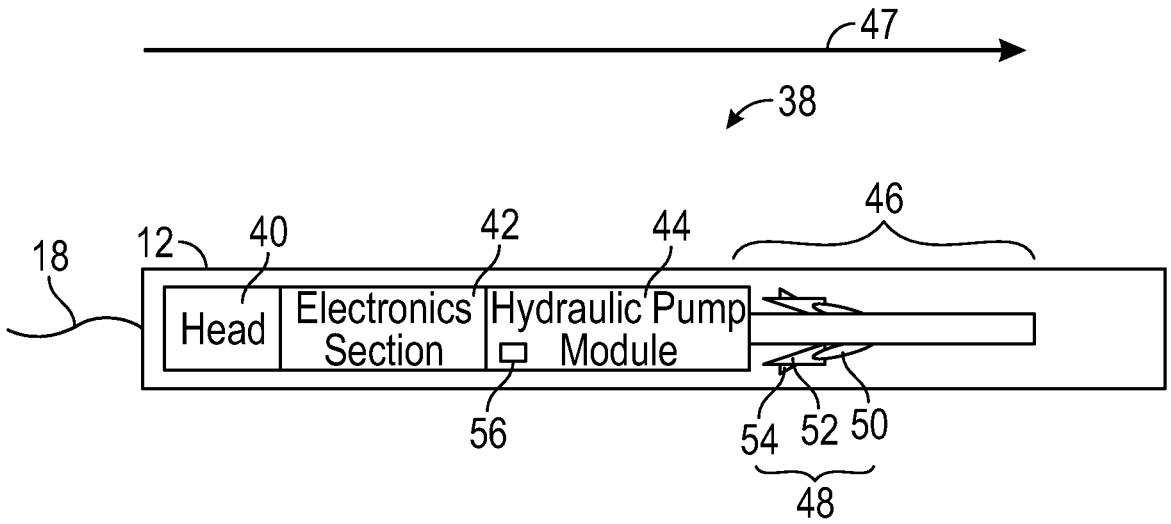
FIG. 2 is a schematic diagram of a downhole tool comprising a mechanical hole puncher, in accordance with an embodiment of the present techniques.

FIG. 2 is a schematic diagram of a downhole tool 12 having a puncher tool 38, in accordance with an embodiment of the present techniques. The illustrated embodiment of the punching tool 38 includes a head portion 40, an electronics section 42, a pump system 44, and a punching system 46, which are each generally disposed along a length (e.g., generally along the direction of the arrow 47) of the downhole tool 12. However, it should be appreciated that in some embodiments, the punching tool 38 may not include one of the portions, such as the head portion 40, or the arrangement of the portions may vary. For example, the electronics section 42 may be disposed upstream (e.g., in a direction opposite the direction arrow 47 is pointing) or downstream (e.g., in the direction arrow 47 is pointing) of the other components, such as the pump system 44 and/or the punching system 46.

In general, the puncher tool 38 may be connected to other components (not shown) of the downhole tool via the head portion 40. The electronics section 42 may include a memory and/or processor that executes certain functions of the puncher tool 38, as discussed herein, via control signals from the processor. The pump system 44 may be a suitable module, such as a hydraulic pump system, that generates a force to actuate components of the punching system 46. The punching system 46 generally includes an arm system 48 having a first arm 50, a second arm 52, and a punching insert 54. In some embodiments, the puncher tool 38 may include sensors 56 that may measure and provide real time feedback indicative of an applied stress by the punching insert 54. For example, the sensors may measure a hydraulic pressure of a hydraulic pump. In some embodiments, the sensors 56 may measure and provide real time feedback indicative of arm pressure, arm force, direct current (DC), radial arm extension length or arm diameter, and downhole temperature and pressure.

In some embodiments, the punching system 46 may include only one or multiple arms (e.g., having only 50 or 52, or including additional arms). While the illustrated embodiment of the punching system 46 in FIG. 2 shows two arm systems 48, in some embodiments, the punching system 46 may include one or more arm systems 48. Additionally, while only one punching system 46 is shown, in some embodiments the puncher tool 38 may include multiple punching systems 46 that may be stacked longitudinally along the downhole tool 12. That is, the puncher tool 38 may include a first punching system that is longitudinally offset from the second punching system. In some embodiments, the arm system of the first punching system may be radially offset from the arm system of the second punching system.

Figure 3:
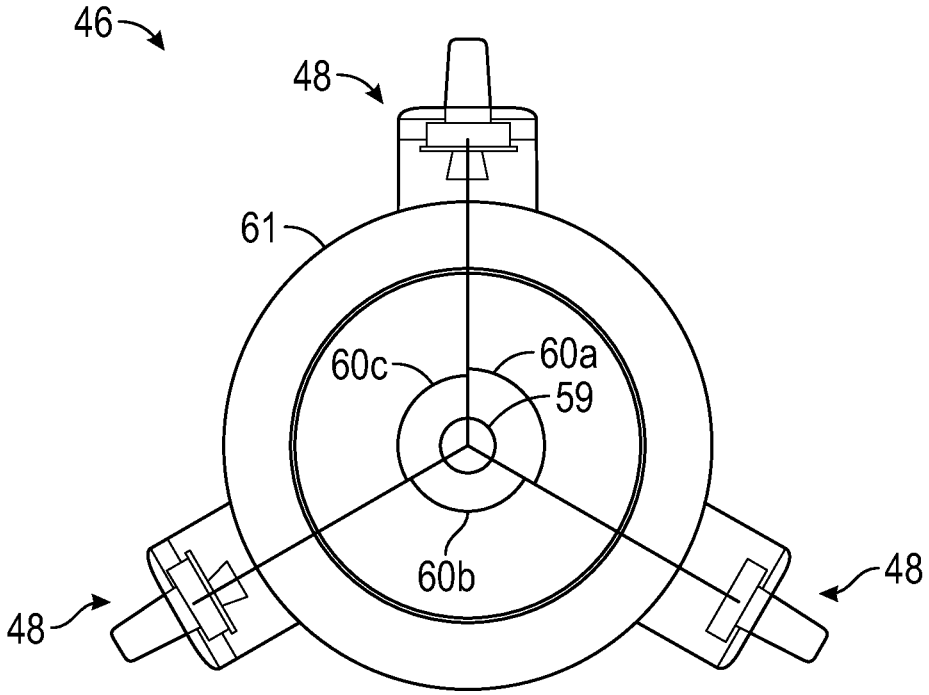
FIG. 3 is a front view along a radial portion of a downhole tool, in accordance with an embodiment of the present techniques.

With respect to the number of arm systems 48, FIG. 3 is a front view along a radial portion of a punching system 46 that has three arm systems 48 extending from a housing 61, in accordance with an embodiment of the present techniques. Each arm system 48 is disposed at a different radial position from the center 59 as in indicated by the radial offset 60 (shown as 60*a*, 60*b*, 60*c*) between each arm system 48. It is presently recognized that including multiple arm systems 48 may facilitate a natural centering effect on the tubing or casing, which may reduce side loading and increase punching efficiency and reliability.

Figure 4:
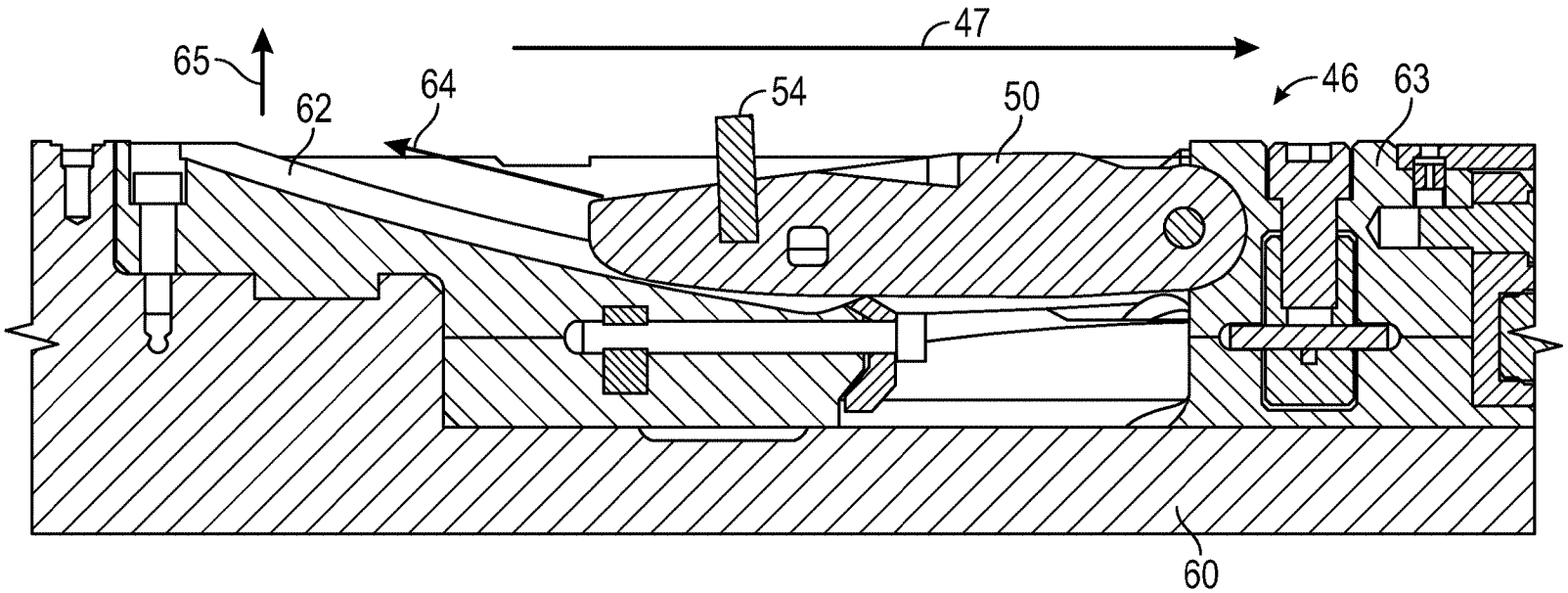
FIG. 4 is a cross-sectional view of a first punching system having a punching insert with a first project surface, in accordance with an embodiment of the present techniques.

FIG. 4 is a cross-sectional view of a second punching system 46 having a punching insert with a first projecting surface, in accordance with an embodiment of the present techniques. In some embodiments, the punching system 46 may be disposed along a length (e.g., generally along the direction of arrow 47) of a downhole tool 12. The punching system 46 includes a punching insert 54, which generally has a projecting surface that is suitable for puncturing a casing and/or tubing. In the illustrated embodiment of the punching system 46 shown in FIG. 4, the first projecting surface of the punching insert 54 is a broach-style punch that uses a hexagon rotary broach inserted into a punching arm. In some embodiments, the punching system 46 may be a repurposed or retro-fitted anchor module. For example, one or more anchor arms of the anchor module may be replaced with arms (e.g., first arm 50) holding a punching insert 54.

In general, an actuator 63 may provide a force (e.g., in a direction opposite arrow 47 that may be provided by the pump system 44) that moves the first arm 50 along the incline 62 in the direction 64. By moving the first arm 50 along the incline 62, the punching insert may provide an outward force (e.g., in a direction 65), which may result in a puncture in a casing and/or tubing.

Figure 5:
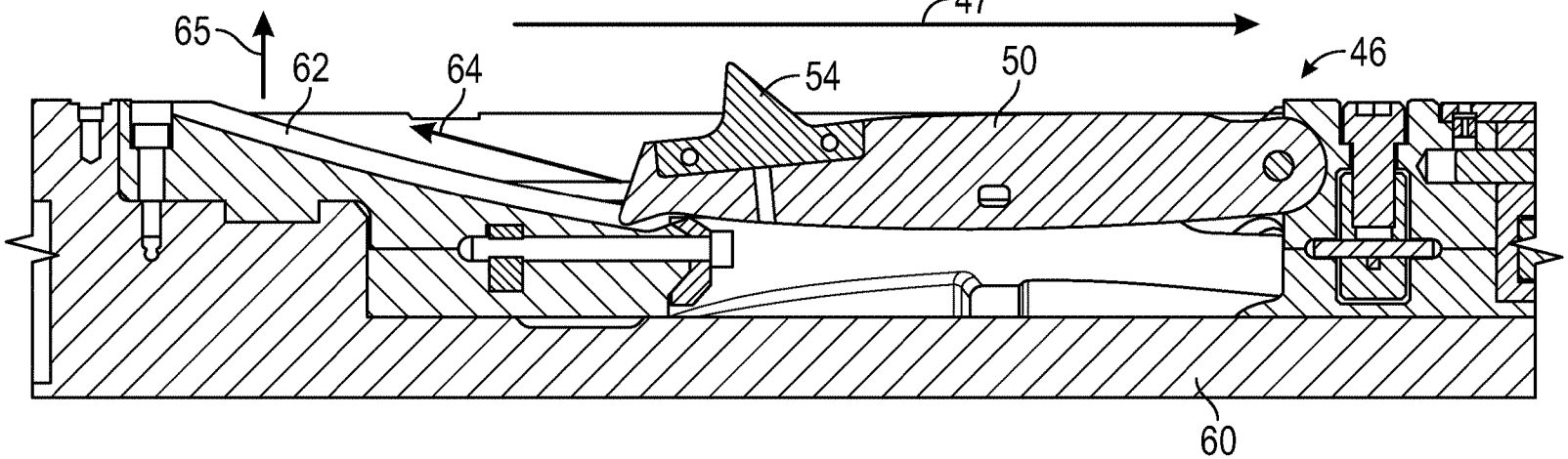
FIG. 5 is a cross-sectional view of a second punching system having a punching insert with a second projecting surface, in accordance with an embodiment of the present techniques.

FIG. 5 is a cross-sectional view of another punching system 46 having a punching insert with a second projecting surface, in accordance with an embodiment of the present techniques. In some embodiments, the punching system 46 may be disposed along of a length (e.g., generally along the direction of arrow 47) of a downhole tool 12. The present embodiment includes a curved ramp of the anchor module and introduces the carbide tooth insert design. The anchor arms are replaced with punching arms capable of holding the punching inserts. It is presently recognized that one advantage of the punching surface shown in the illustrated embodiment of the punching insert 54 is a reduced likelihood of producing slugs that may fall within the wellbore as the punching insert punctures or pushes through the casing. That is, the tooth shape may create holes without leaving any material downhole. After the puncher has completed one cycle (e.g., translating in direction 64 and returning along the opposite direction) to create the holes, a strip of peeled back casing material may be attached to the casing. Such a created hole may have sizable flow area with no internal casing damage. As discussed herein, certain conventional puncturing techniques such as explosive perforations may create internal burrs which make it difficult to slide tools/equipment through that section of the casing. A punching system in accordance with the embodiments described herein may result in a smooth internal surface of the casing where the holes are created, and as such, reduce or substantially eliminate such difficulties when sliding tools/equipment through casing.

Figure 6A:
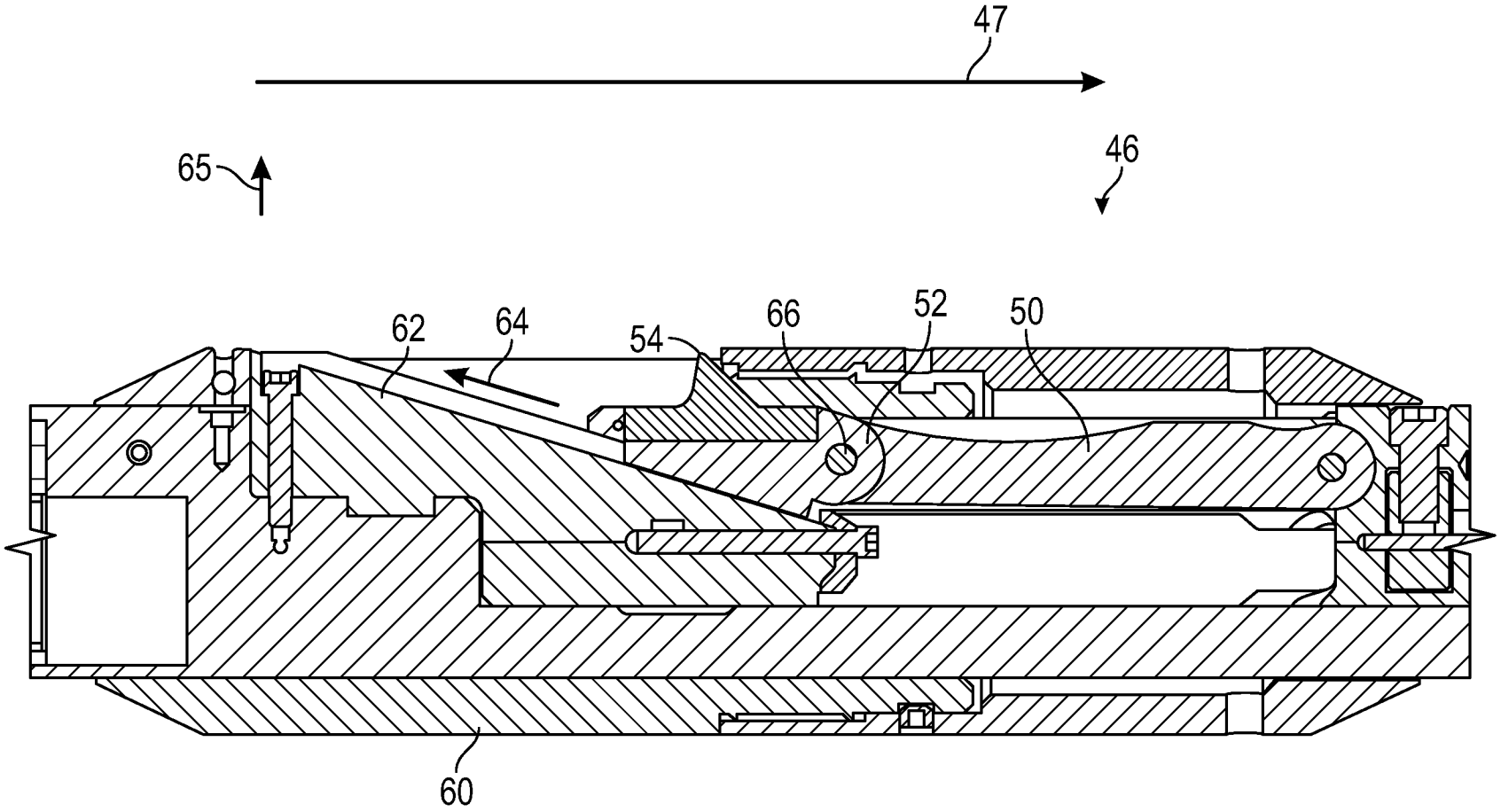
FIG. 6A is a cross-sectional view of a third punching system having retracted arms, in accordance with an embodiment of the present techniques.
Figure 6B:
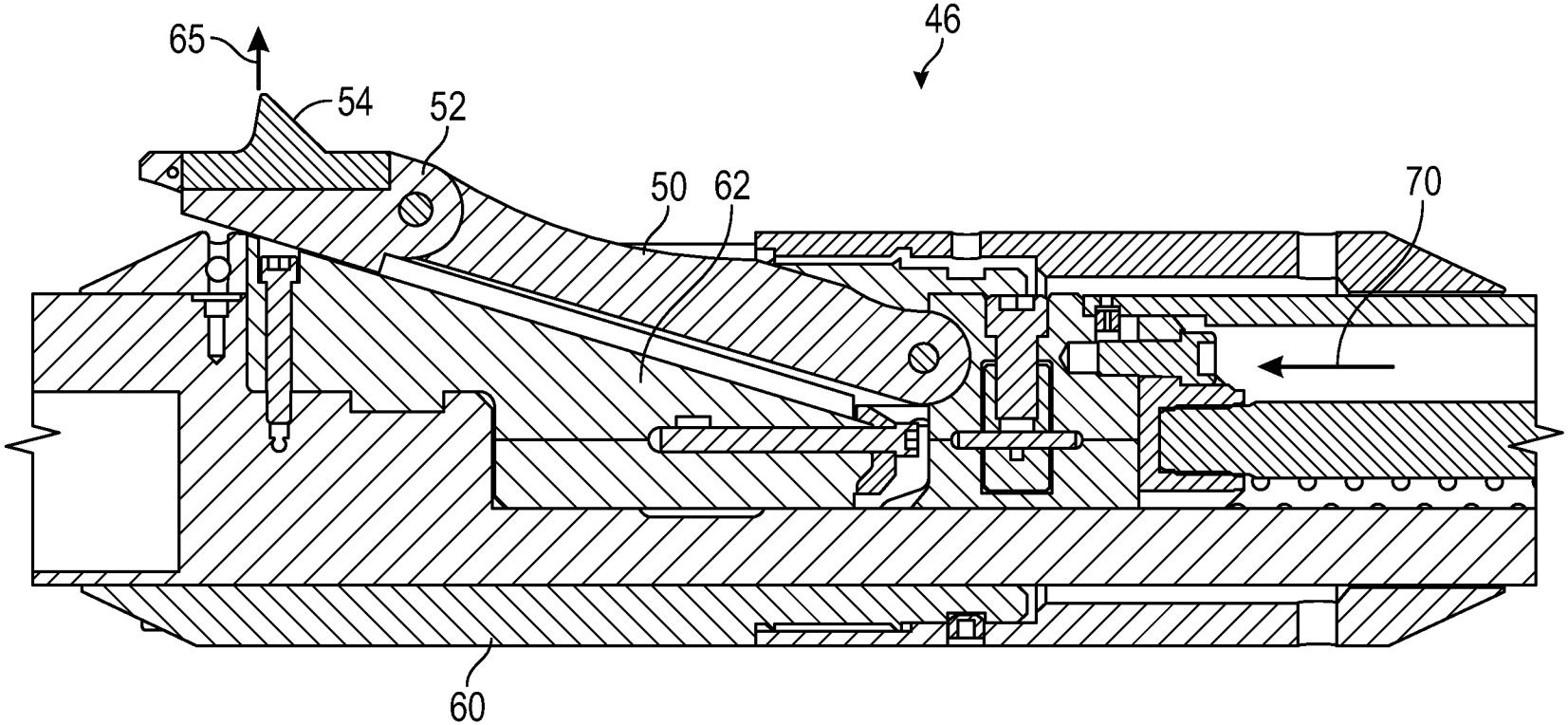
FIG. 6B is a cross-sectional view of the third punching system having extended arms, in accordance with the present techniques.

FIG. 6A is a cross-sectional view of another punching system 46 that may be disposed along a length (e.g., generally along the direction of arrow 47) of a downhole tool 12, in accordance with an embodiment of the present techniques. In general, the illustrated embodiment of the punching system 46 of FIG. 6A has arms 50 and 52, and a punching insert 54. In particular, the arm 52 has an incline surface to provide a constant angle of the punching insert 54 for improved reliability and radial force. This iteration still utilizes the carbide tooth design with modifications to improve reliability. As discussed above, with respect to FIGS. 4 and 5, arms may receive a force (e.g., compressive force generated by the pump system 44) that moves the arms 50 and 52 in a direction 64, such that the punching insert may interact with (e.g., come in contact with) a casing and/or tubing to produce a puncture of perforation. FIG. 6B is a cross-sectional view of the punching system 46 with the arms 50 and 52 extended, in accordance with the present techniques.

Figure 7A:
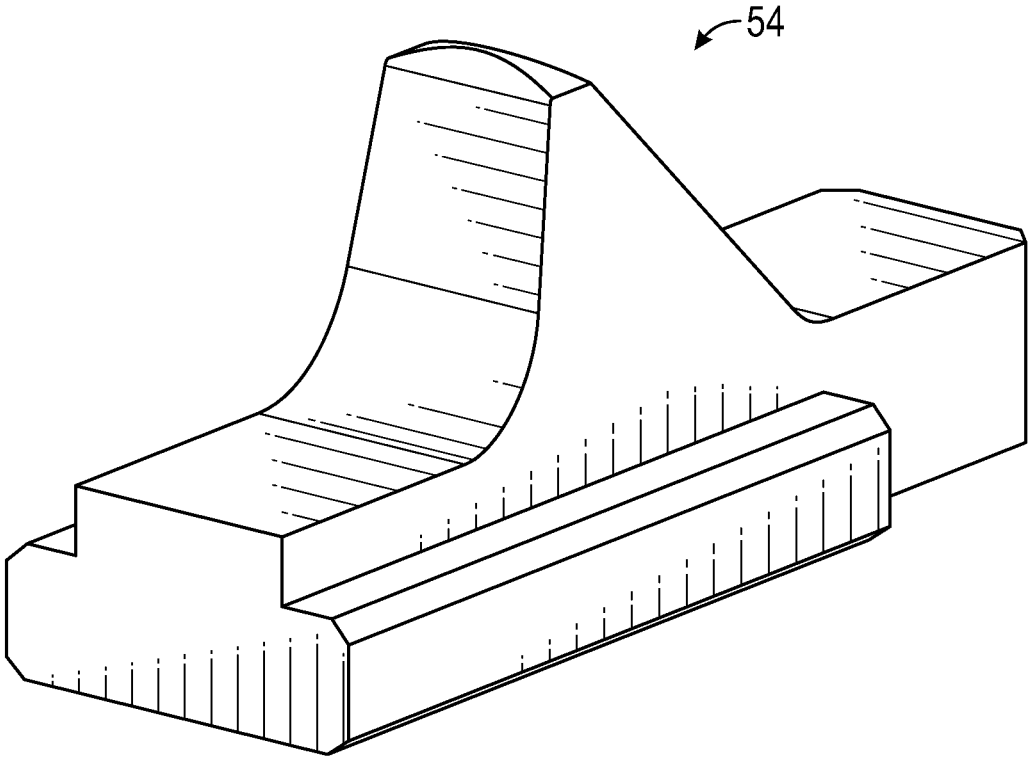
FIG. 7A illustrates a perspective view of a punching insert for a mechanical hole puncher.
Figure 7B:
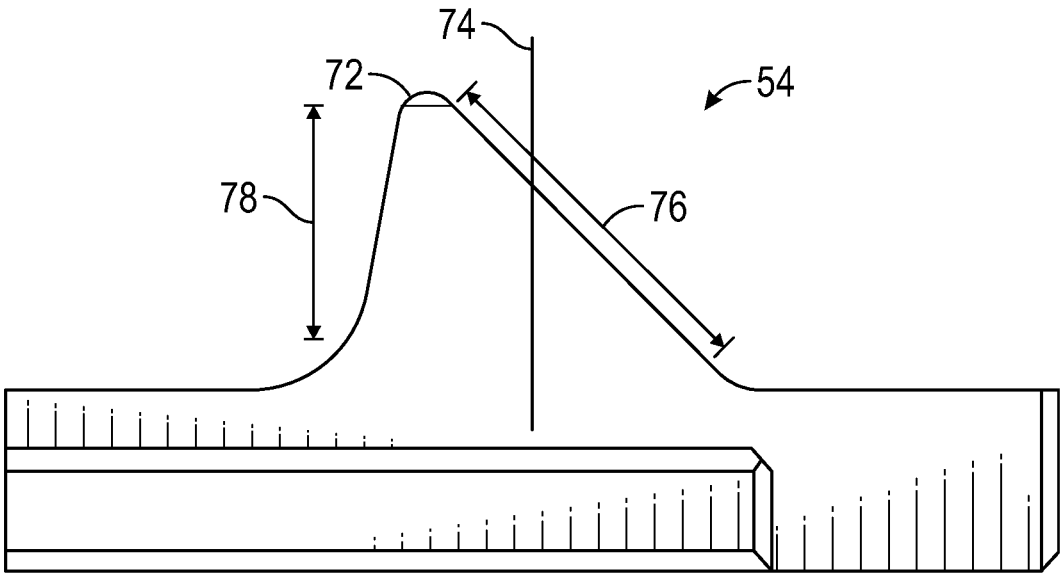
FIG. 7B illustrates a side view of the punching insert shown in FIG. 7A for a mechanical hole puncher, in accordance with the present techniques.

FIG. 7A illustrates a perspective view of a punching insert 54 for a mechanical hole puncher. FIG. 7B illustrates a side view of the punching insert 54 shown for a mechanical hole puncher, in accordance with the present techniques. The carbide insert could be replaced by a similar insert made of other materials. The tooth shape of the punching insert 54 may provide a sharp edge to penetrate the casing and initiate the hole punching process. The angled back side 78 of the insert may add integrity to the insert for improved reliability while also acting as the loading surface for peeling back the casing as the arms are stroked further out radially. The insert 54 may be made of solid carbide to reduce stress concentrations. In general, there are several mechanical properties for a suitable punching insert. For example, a punching insert 54 may have hardness and high yield strength, but also be brittle so the tips can be easily broken off, such as in an emergency situation. In some embodiments, the punching insert may be made of a carbide, carbide alloy (e.g., tungsten carbide), certain polymers, or various other metals. In situations, it may be advantageous that the punching insert 54 be composed of some amount of carbide. For example, if the carbide fails (e.g., is unable to puncture a tubing and/or casing resulting in breakage of the punching insert 54) during operation, a carbide punching insert generally breaks down into smaller pieces rather than staying as one large, solid piece of material.

While the illustrated embodiment of the punching insert 54 generally has a tooth shape, it should be appreciated that various other shapes may provide suitable puncturing of tubing and/or casing, such as not creating burrs and puncturing the tube with relatively less applied force (e.g., from the pump system 44). For example, the top portion 72 of the punching insert 54 may be sharp, pointed, or beveled. Additionally, the top portion 72 may be offset or aligned with a central axis 74 of the punching insert 54. Furthermore, the angled front side 76 of the punching insert 54 may have a slope that is greater, less than, or equal to the angled back side 78. Further still, the punching insert could be replaced by an insert with a different shape (e.g. hexagonal, round, etc.) and size. As discussed herein, any puncher design where the single punch point may be replaced by multiple punching points per arm (e.g. two punching points back to back on one insert). Further, the punching insert 54 may be integrated into the punching arm itself rather than as a separate insert.

Figure 8:
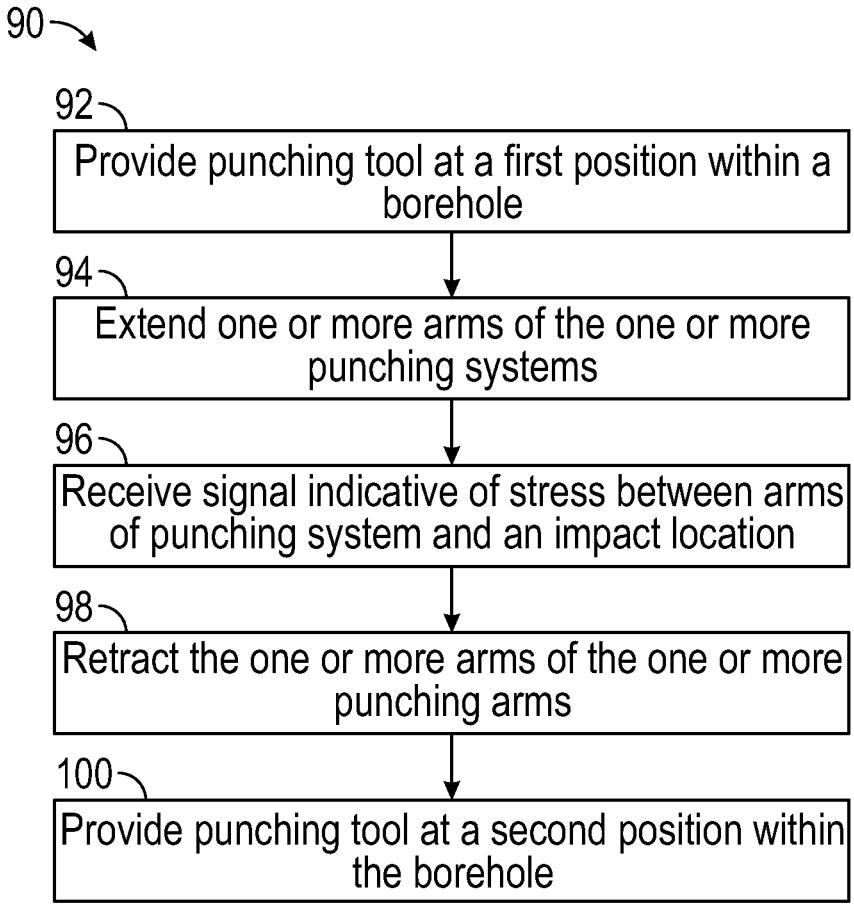
FIG. 8 is a flow diagram for creating holes along a wall of a downhole tool, in accordance with the present techniques.
Figure 9:
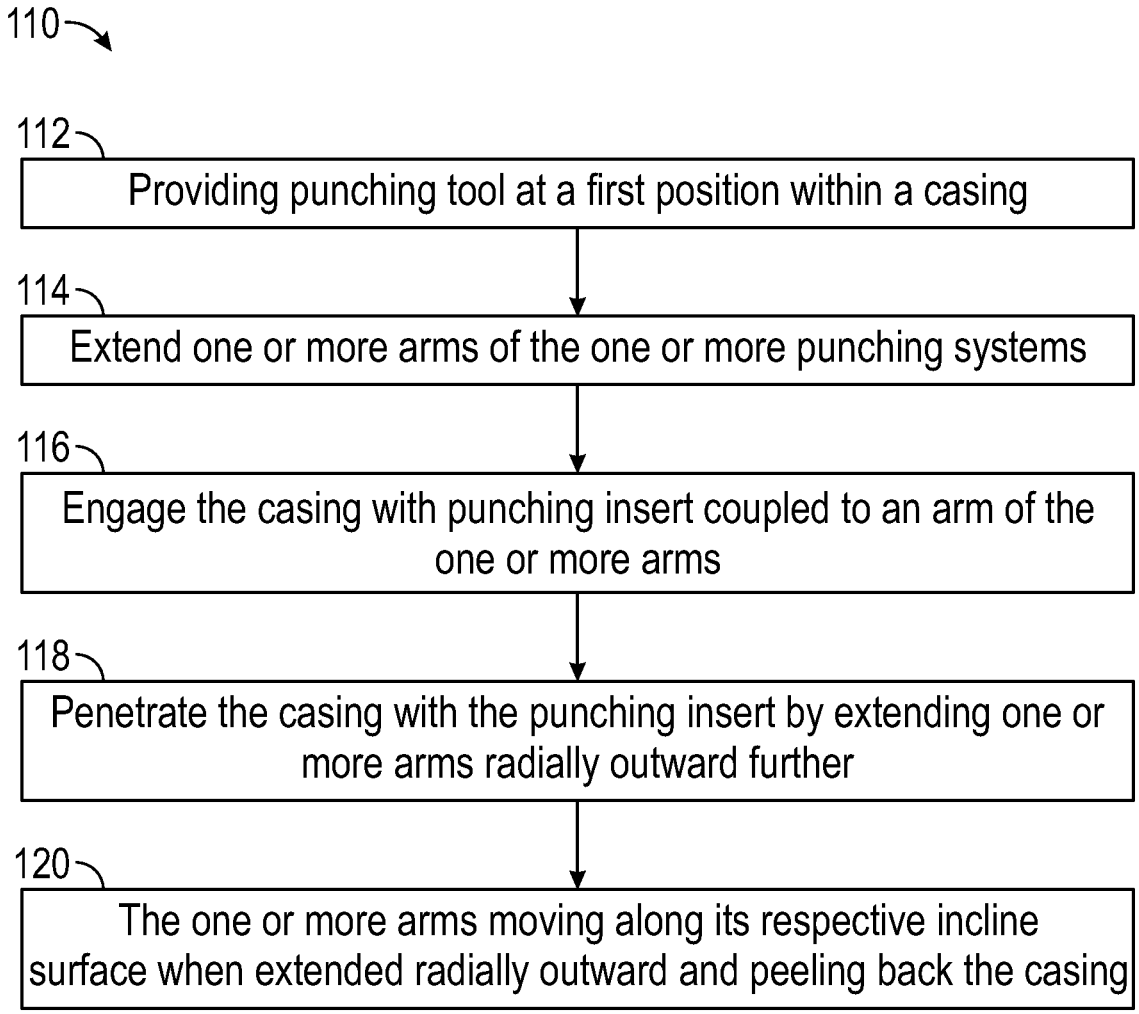
FIG. 9 is a flow diagram for creating a hole along a wall of a downhole tool, in accordance with an embodiment of the present techniques disclosed.

FIG. 8 is a flow diagram 90 for creating holes along a wall of a downhole tool, in accordance with the present techniques. In general, the flow diagram 90 may include receiving a measurement indicative of the stress between a punching system and a casing and/or tubing to provide real time feedback to an operator or a data processing system. The elements illustrated in the flow diagram 90 may be performed by the data processing system 28 or any suitable processing system.

The illustrated embodiment of the flow diagram 90 in FIG. 8 begins with providing (e.g., block 92) a punching tool at a first position with in a borehole. The flow diagram also includes extending (e.g., block 94) one or more arms of the one or more punching systems. Additionally, the flow diagram 90 includes receiving (e.g., block 96) a signal indicative of stress between the one or more arms of the punching system and the casing and an impact location, such as a region or point along a casing and/or tubing. Then, the flow diagram 90 includes retracting (e.g., block 98) the one or more arms of the one or more punching arms. Further, the flow diagram 90 includes providing (e.g., block 100) the punching tool at a second position within the borehole.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A downhole tool including a downhole puncher tool, the downhole puncher tool comprising:

a pump system configured to produce a force; and a plurality of arm systems disposed in a housing, wherein each arm system includes one or more arms that are configured to extend radially outward from the housing upon receiving the force from the pump system and engage a downhole tubular;

wherein at least one arm system of the plurality of arm systems comprises a punching insert that is coupled to an arm of the one or more arms, and wherein the punching insert has a projecting surface comprising:

a sharp edge to penetrate the downhole tubular to initiate a hole when the arm of the one or more arms is extended radially outward; and an angled backside for peeling back the downhole tubular as the arm of the one or more arms is further extended radially outward;

wherein the housing comprises an incline surface for each arm; and wherein each arm of the one or more arms is configured to move along its respective incline surface when extended radially outward from the housing such that each arm of the one or more arms and the punching insert coupled to the arm of the one or more arms is configured to move along a longitudinal length of the downhole tubular, the incline surface orienting the punching insert at a constant angle relative the downhole tubular.

2. The downhole puncher tool of claim 1, comprising one or more sensors configured to measure feedback indicative of an applied stress from the punching insert.

3. The downhole puncher tool of claim 2, wherein the feedback indicates one of a successful perforation or puncture, a failed perforation or puncture, a stuck puncher tool, or a damaged punching insert.

4. The downhole puncher tool of claim 1, comprising one or more sensors configured to measure at least one of arm pressure, arm force, direct current (DC), radial arm extension length or arm diameter, and downhole temperature and pressure.

5. The downhole puncher tool of claim 1, wherein the projecting surface of the punching insert is a tooth shape.

6. The downhole puncher tool of claim 1, wherein the punching insert comprises a broach-style punch.

7. The downhole puncher tool of claim 6, wherein the broach-style punch uses a hexagon rotary broach.

8. The downhole puncher tool of claim 1, wherein a top portion of the punching insert is beveled.

9. The downhole puncher tool of claim 1, wherein a top portion of the punching insert is sharp and pointed.

10. The downhole puncher tool of claim 1, wherein an angled front side of the punching insert has a slope greater than a slope of the angled back side of the punching insert, the angled front side and the angled back side extending away from one another from a top portion.

11. The downhole puncher tool of claim 1, wherein an angled front side of the punching insert has a slope less than a slope of the angled back side of the punching insert, the angled front side and the angled back side extending away from one another from a top portion.

12. The downhole puncher tool of claim 1, wherein an angled front side of the punching insert has a slope equivalent to a slope of the angled back side of the punching insert, the angled front side and the angled back side extending away from one another from a top portion.

13. The downhole puncher of claim 1, wherein the downhole puncher tool comprises an additional plurality of arm systems longitudinally offset from the plurality of arm systems.

14. The downhole puncher of claim 1, wherein the downhole puncher tool comprises an additional plurality of arm systems radially offset from the plurality of arm systems.

15. The downhole puncher tool of claim 1, wherein the arm of the one or more arms has an incline surface configured to maintain the punching insert at a constant angle when the arm is extended radially outward.

16. The downhole puncher tool of claim 1, further comprising a sensor configured to measure an arm force of the arm of the one or more arms when the punching insert coupled thereto engages the downhole tubular.

17. A downhole tool including a downhole puncher tool, the downhole puncher tool comprising:

a pump system configured to produce a force; and a plurality of arm systems disposed in a housing, wherein each arm system includes one or more arms that are configured to extend radially outward from the housing upon receiving the force from the pump system and engage a downhole tubular;

wherein at least one arm system of the plurality of arm systems comprises a punching insert that is coupled to an arm of the one or more arms, and wherein the punching insert has a projecting surface comprising:

a sharp edge to penetrate the downhole tubular to initiate a hole when the arm of the one or more arms is extended radially outward; and an angled backside for peeling back the downhole tubular as the arm of the one or more arms is further extended radially outward;

wherein the housing comprises an incline surface for each arm; and wherein each arm of the one or more arms is configured to move along its respective incline surface when extended radially outward from the housing such that each arm of the one or more arms and the punching insert coupled to the arm of the one or more arms moves along a longitudinal length of the downhole tubular, the incline surface orienting the punching insert at a constant angle relative the downhole tubular; and wherein the downhole tool is conveyed downhole by a wireline cable.

18. A method for creating a hole in a downhole tubular, the method comprising:

conveying a downhole tool on a wireline cable into the downhole tubular, wherein the downhole tool includes a downhole puncher tool;

positioning the downhole puncher tool at a first position within the downhole tubular;

extending one or more arms of a plurality of arm systems radially outward, wherein at least one arm system of the plurality of arm systems comprises a punching insert that is coupled to an arm of the one or more arms;

engaging the downhole tubular with the punching insert, wherein the punching insert has a projecting surface;

penetrating the downhole tubular with the punching insert to initiate a hole when the arm of the one or more arms is extended radially outward; and peeling back the downhole tubular by moving the arm of the one or more arms along a longitudinal length of the downhole tubular and further extending the arm of the one or more arms radially outward.

19. The method of claim 18, wherein the arm of the one or more arms is moved along an incline surface of the downhole puncher tool as the arm of the one or more arms moves along the longitudinal length of the downhole tubular.

20. The method of claim 18, further comprising measuring an arm force of the arm of the one or more arms with a sensor when the punching insert coupled thereto engages the downhole tubular.

* * * * *